US006412118B1

(12) United States Patent
Shanklin

(10) Patent No.: US 6,412,118 B1
(45) Date of Patent: Jul. 2, 2002

(54) POCKET HANDKERCHIEF

(76) Inventor: Garland R. Shanklin, 6410 Ferris St., #23, Houston, TX (US) 77081

( * ) Notice: Subject to any disclaimer, the term of this patent is extended or adjusted under 35 U.S.C. 154(b) by 0 days.

(21) Appl. No.: 09/834,336

(22) Filed: Apr. 13, 2001

(51) Int. Cl.[7] ..... A41B 18/00
(52) U.S. Cl. ..... 2/279
(58) Field of Search ..... 2/279, 197, 207

(56) References Cited

U.S. PATENT DOCUMENTS 2,060,729 A * 11/1936 Gilgenbach ..... 35/56
2,200,601 A * 5/1940 Grunwold ..... 223/111
3,512,182 A * 5/1970 Bezanilla ..... 2/279
3,704,470 A * 12/1972 Beno et al. ..... 2/279
3,786,520 A * 1/1974 Harmon ..... 2/279

* cited by examiner

*Primary Examiner*—John J. Calvert
*Assistant Examiner*—James G Smith
(74) *Attorney, Agent, or Firm*—Carrie A. Boone, P.C.

(57) ABSTRACT

A pocket handkerchief is arranged to be displayed from a pocket, such as a breast pocket of a business suit. The pocket handkerchief is woven entirely of fabric and stitched such that an ornamental part of the handkerchief is visible when deposited in the pocket. The pocket handkerchief may be useful as a handkerchief, when needed. After use, the pocket handkerchief may be returned to the pocket and thereafter maintain its stylish quality.

9 Claims, 5 Drawing Sheets

POCKET HANDKERCHIEF

BACKGROUND

This invention relates to pocket handkerchiefs for suit pocket adornment.

The use of handkerchiefs to adorn the pocket of a dress suit is familiar to those who observe fashion trends. Dapper dressers are known to coordinate a necktie with a matching handkerchief, for example, where the handkerchief is extended from a suit breast pocket such as to be visible.

Arranging the handkerchief to achieve the desired presentation is often difficult. The handkerchief may not be large enough to stick out of the breast pocket and folding the handkerchief may be cumbersome as well. Such frustration may lead many otherwise style-conscious dressers to abandon the accessory.

Further, for those dressers who are successful at creating a stylish presentation, the handkerchief may lose its usefulness. Especially where the dresser spent much time preparing the handkerchief, he may be unwilling to reach for the handkerchief during a sneeze. Utility, and maybe even chivalry, is thus lost to the desire to maintain a stylish appearance.

Different mechanisms have been employed to assist in presenting the handkerchief. For example, some handkerchiefs may be purchased, already folded, with cardboard around the folded handkerchief, ensuring that part of the handkerchief is visible from the pocket. Alternatively, a style-conscious person may purchase an implement, in which the handkerchief is clipped to the implement, and then the implement is put in the pocket. Both solutions are bulky and ultimately may prevent the wearer from using the handkerchief as a handkerchief, e.g., as a wiping tool.

Thus, there is a continuing need for a pocket handkerchief that is readily attractive and that maintains its usefulness.

DETAILED DESCRIPTION

According to the embodiments described herein, a pocket handkerchief is disclosed which is arranged to be displayed from a pocket, such as a breast pocket of a business suit. The illustrative pocket handkerchief is woven entirely of fabric, stitched such that part of the handkerchief is ornamental, and thus visible when deposited in a pocket. Despite its ornamental quality, the pocket handkerchief remains useful as a handkerchief, when needed. After use, the pocket handkerchief may be returned to the pocket and thereafter maintain its stylish quality.

Figure 1:
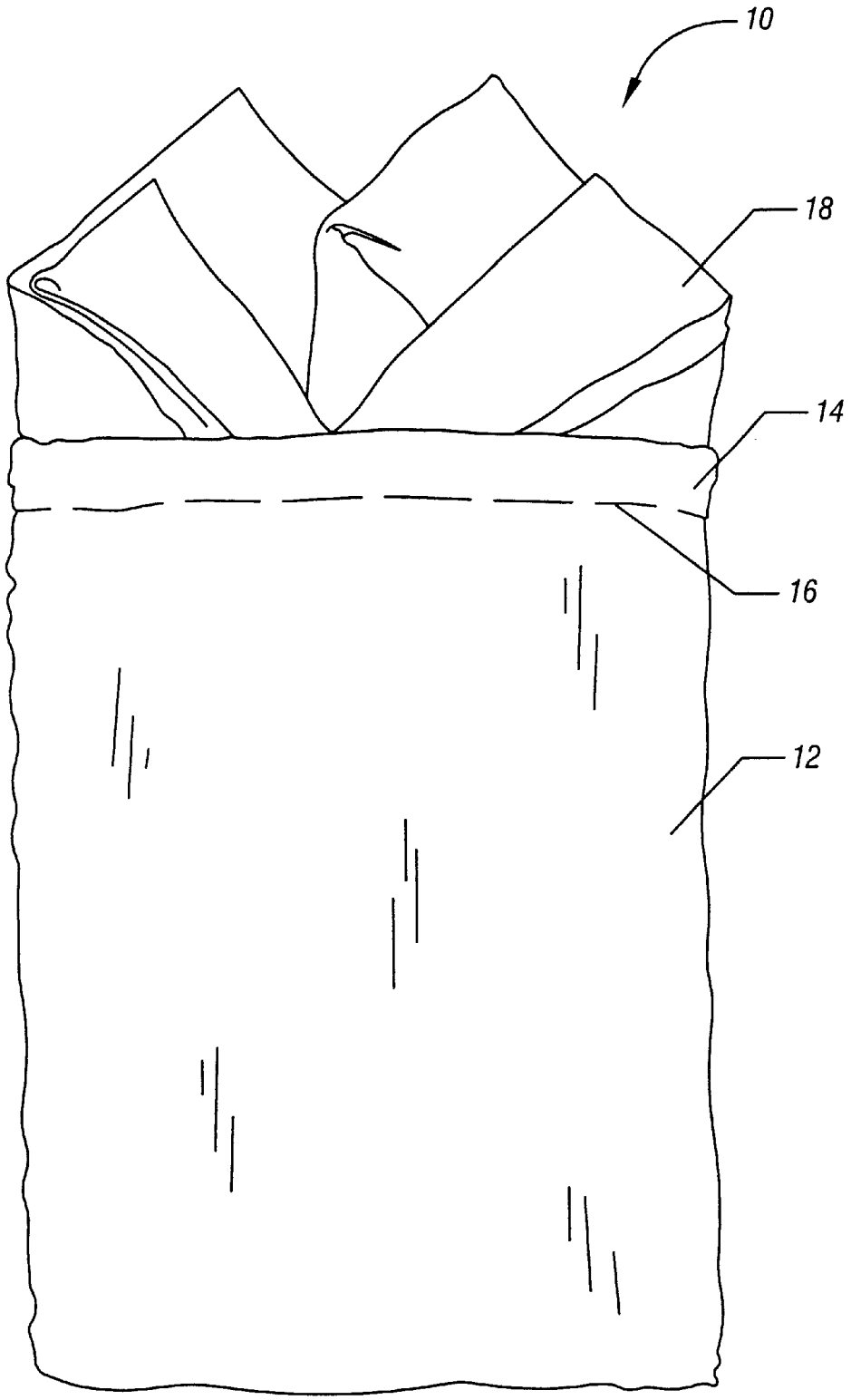
FIG. 1 is diagram of a pocket handkerchief according to one embodiment of the invention.

In FIG. 1, according to one embodiment, a pocket handkerchief 10 includes a base portion 12, a midsection portion 14, and a display portion 18. The base portion 12, midsection portion 14, and display portion 18 comprise fabric material, such as cotton, silk, polyester, or other materials commonly used to make stylish handkerchiefs. Combinations of these materials may also be used.

In one embodiment, the pocket handkerchief 10 is arranged from a single piece of fabric material. In another embodiment, the display portion 18 is crafted from a first piece of material while the base portion 12 is a second, separate piece of material.

The base portion 12 and the display portion 18 are coupled to each other at the midsection portion 14. In one embodiment, the display portion 18 is stitched to the base portion 12 by a stitch line 16, as illustrated in FIG. 1. The stitch line 16 essentially causes the midsection portion 14 to be fabricated from the base portion 12.

The display portion 18 may be arranged in a variety of attractive folds before being stitched to the base portion 12. In FIG. 1, the display portion 18 is arranged as an ascending array of scalloped folds. In other embodiments, the display portion 18 may be pre-stitched in any of a variety of fashionable presentations.

Figure 2:
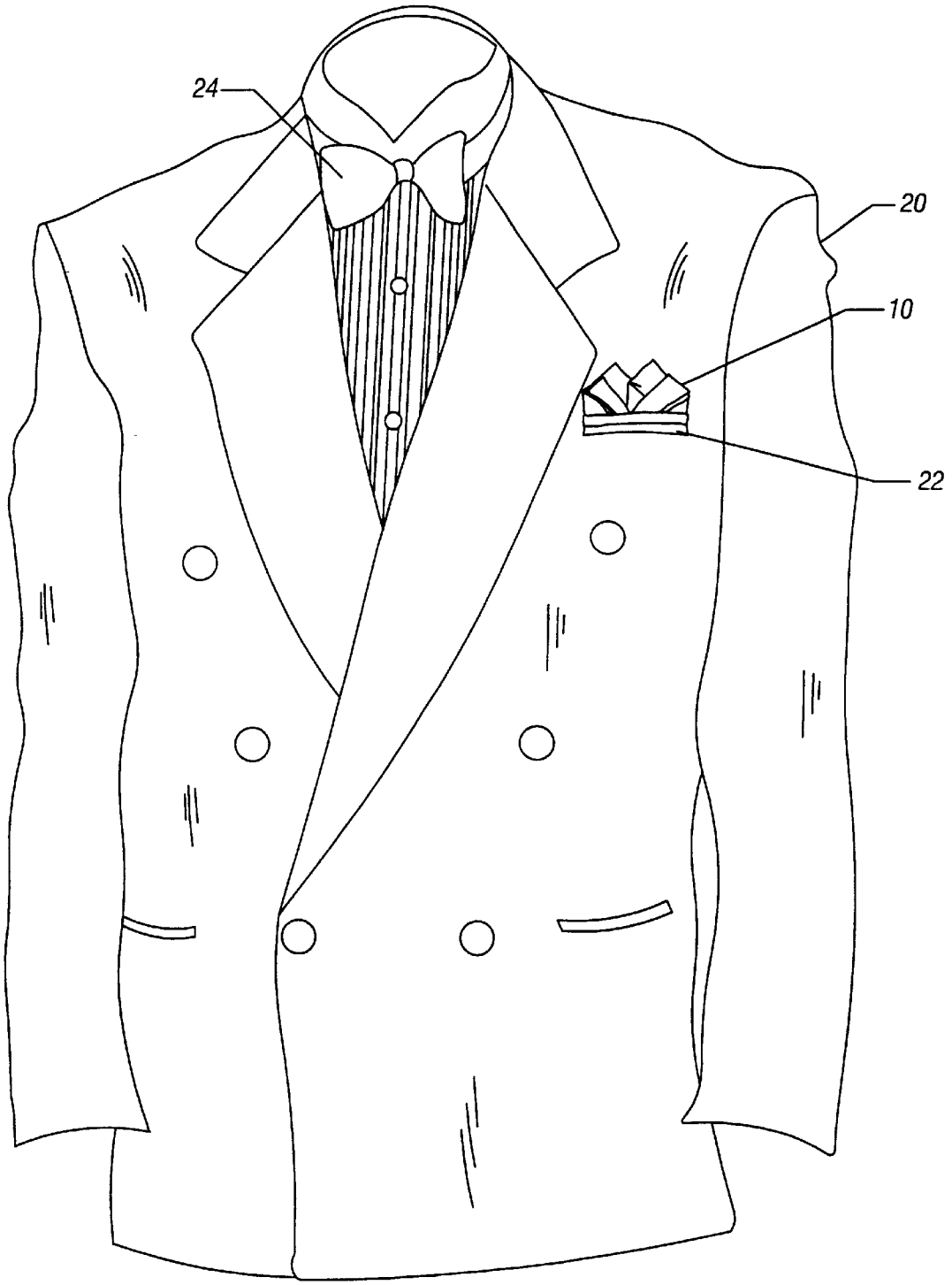
FIG. 2 is a diagram of the pocket handkerchief of FIG. 1 in a suit breast pocket according to one embodiment of the invention.

In FIG. 2, the pocket handkerchief 10 is shown in a breast pocket 22 of a business suit 20, according to one embodiment. As shown, only the display portion 18 of the pocket handkerchief 10 is visible, whereas the base portion 12 is hidden from view. The pocket handkerchief 10 may be used to accent a tie 24. For example, the tie 24 and the pocket handkerchief 10 may be sewn from identical fabric. As another example, the tie 24 may be multi-colored, while the pocket handkerchief 10 is made from fabric of one of the multiple colors featured in the tie 24.

Figure 3:
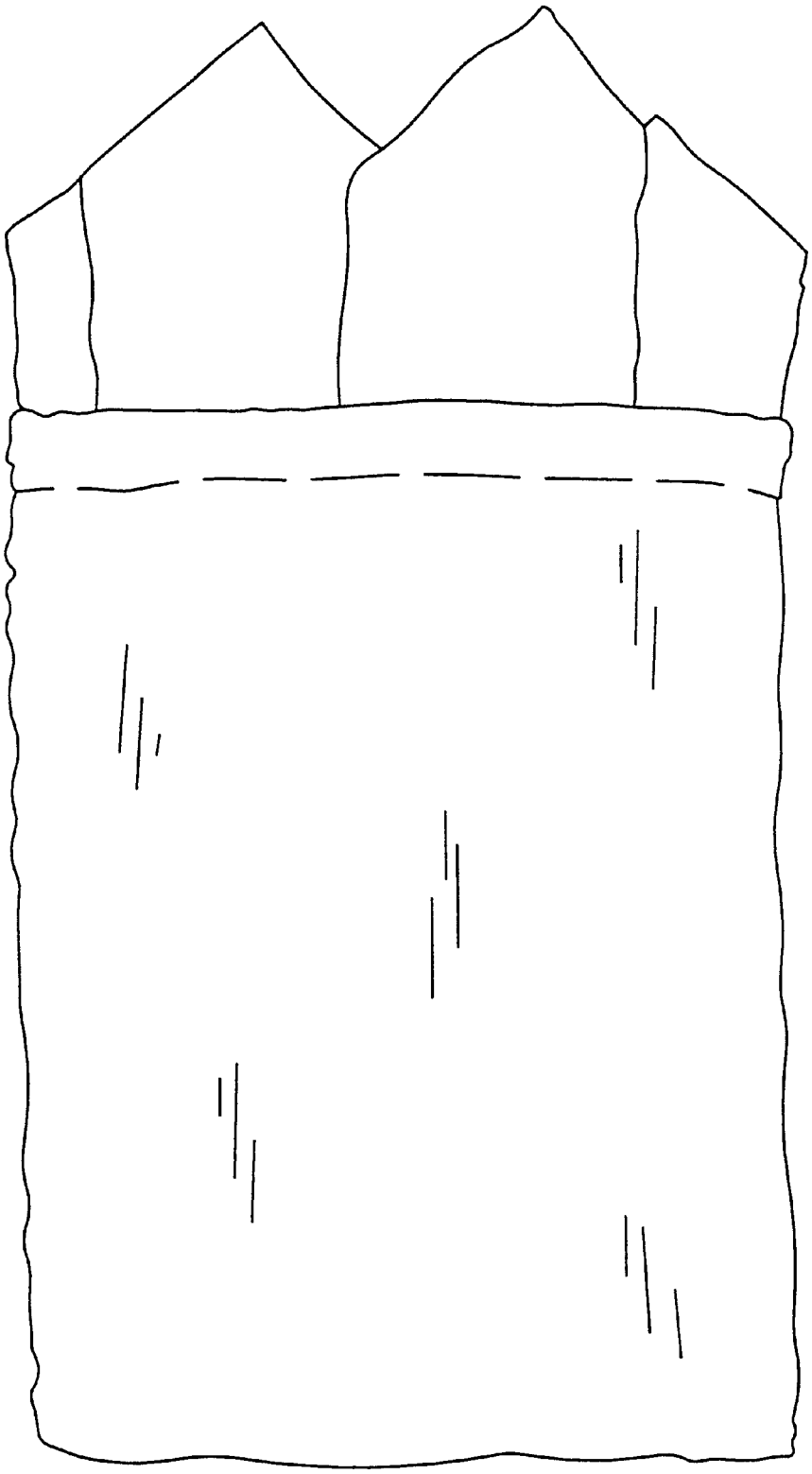
FIG. 3 is a back view of the pocket handkerchief of FIG. 1 according to one embodiment of the invention.
Figure 4:
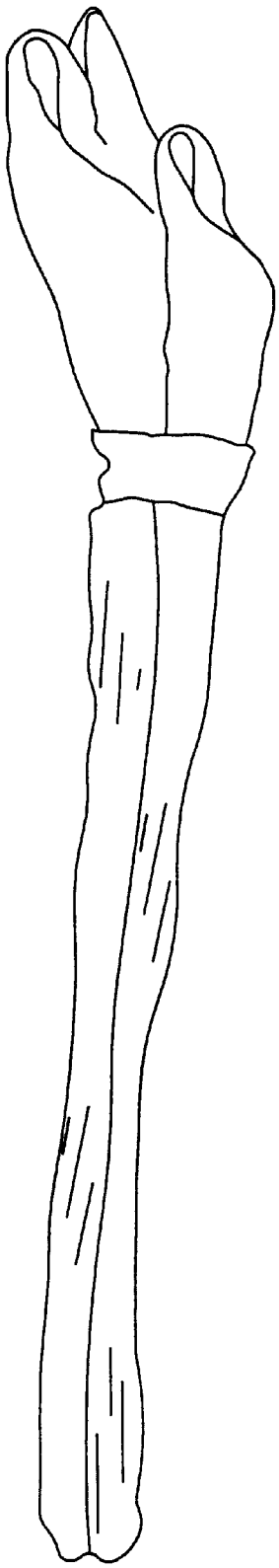
FIG. 4 is a side view of the pocket handkerchief of FIG. 1 according to one embodiment of the invention.

FIG. 3 is a back view of the pocket handkerchief 10, according to one embodiment. FIG. 4 is a side view of the pocket handkerchief 10. The base portion 12 may be inserted in a pocket, hidden from view, while the display portion 18 is visible as a stylish adornment to a suit or other breast pocket.

Figure 5:
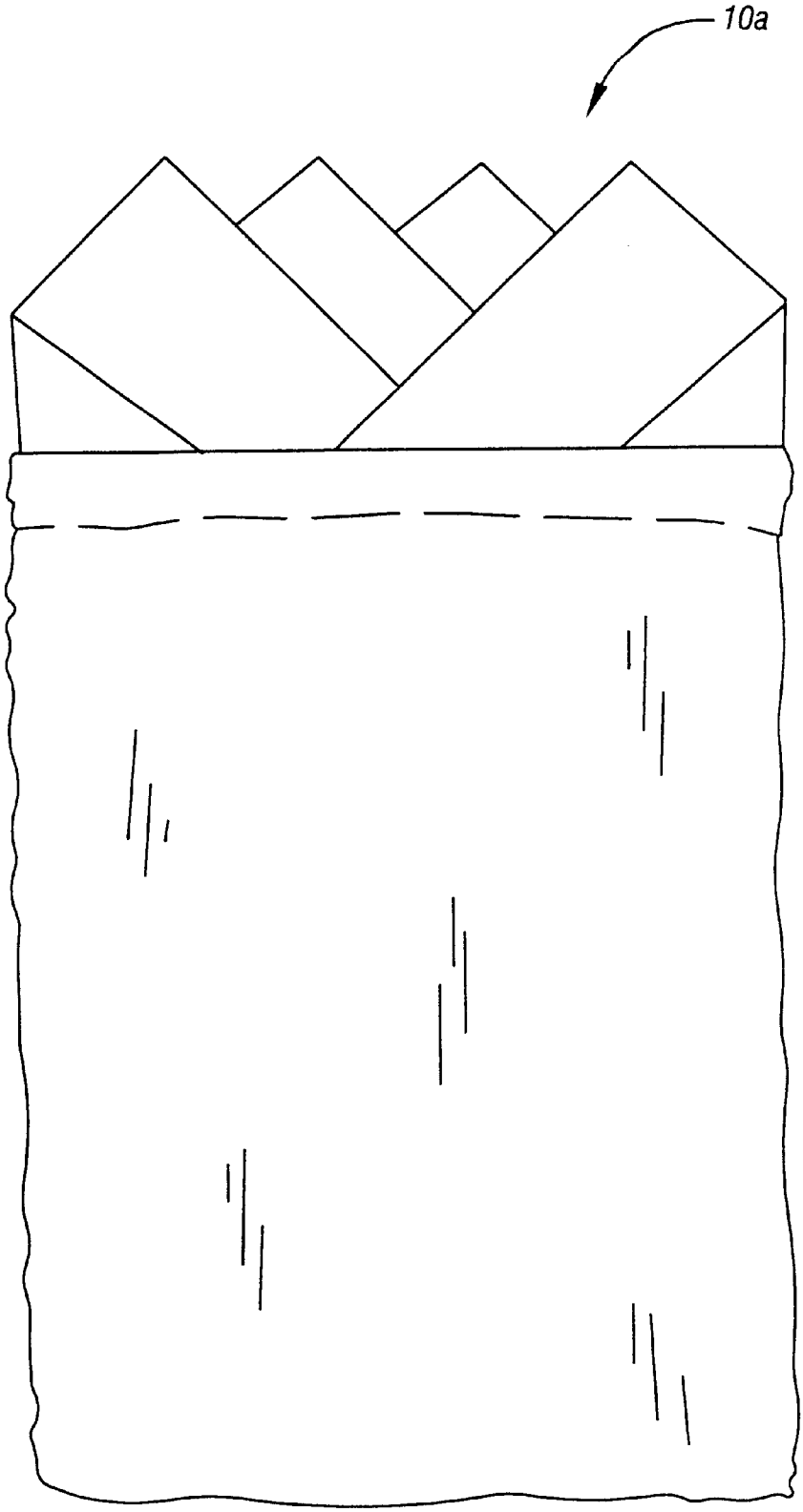
FIG. 5 is a diagram of a second pocket handkerchief according to one embodiment of the invention.

In FIG. 5, a second pocket handkerchief 10*a* includes a display portion 18 that is different from the pocket handkerchief 10 of FIG. 1. The display portion 18 of the pocket handkerchief 10*a* features more sharp edges than the softly folded edges of the pocket handkerchief 10.

FIGS. 1 and 5 illustrate two of many possible modifications that may be made to the pocket handkerchief 10. Each may evoke a distinct style for the accessorizing dresser. Examples of display portions 18 that may be found on the pocket handkerchief 10 include scalloped, laced, and embroidered edges, to name but a few examples.

Because the pocket handkerchief 10 is constructed entirely from fabric, the pocket handkerchief 10 may be used as a handkerchief. In one embodiment, the pocket handkerchief 10 is constructed of washable fabric, such that the handkerchief may be used repeatedly. This contrasts to handkerchiefs, which have a cardboard base, which are unlikely to be removed from the pocket and used. Likewise, handkerchiefs, which are displayed using an implement to hold them in the pocket, could be used only after removing the handkerchief from the implement.

Thus, the illustrative pocket handkerchief offers both a stylish adornment without fuss and maintains its usefulness as a wiping tool.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A pocket handkerchief comprising:

a base portion comprising fabric arranged in a contiguous unfolded area to be received into a pocket, wherein the base portion is independent of a stiffening means; and a display portion coupled to the base portion, wherein the display portion is visible once the base portion is in the pocket.

2. The pocket handkerchief of claim 1, further comprising:

a stitch line for coupling the base portion to the display portion.

3. The pocket handkerchief of claim 1, wherein the display portion comprises the fabric of the base portion.

4. The pocket handkerchief of claim 1, wherein the display portion comprises a second fabric.

5. A method of arranging a handkerchief for display from a pocket, comprising:

gathering a first fabric portion to be visible;

assembling a second fabric portion to fit in the pocket, wherein the second fabric portion comprises a contiguous unfolded area independent of a support material; and securing the first fabric portion to the second fabric portion.

6. The method of claim 5, securing the first fabric portion to the second fabric portion further comprising sewing a stitch line between the first fabric portion and the second fabric portion.

7. The method of claim 6, folding a second fabric portion to fit in the pocket further comprising folding the second fabric portion into a rectangular configuration.

8. The method of claim 5, further comprising:

inserting the second fabric portion inside the pocket, wherein the first fabric portion remains outside the pocket.

9. The method of claim 8, further comprising:

removing the second fabric portion from the pocket to wipe an object; and returning the second fabric portion to the pocket.

* * * * *

US006412118C1

(12) EX PARTE REEXAMINATION CERTIFICATE (5007th)

United States Patent
Shanklin

(10) Number: US 6,412,118 C1
(45) Certificate Issued: Oct. 26, 2004

(54) POCKET HANDKERCHIEF

(75) Inventor: Garland R. Shanklin, 6410 Ferris St., #23, Houston, TX (US) 77081

(73) Assignee: Garland R. Shanklin, Houston, TX (US)

Reexamination Request:
No. 90/006,528, Feb. 10, 2003

Reexamination Certificate for:

| | |
|---|---|
| Patent No.: | **6,412,118** |
| Issued: | **Jul. 2, 2002** |
| Appl. No.: | **09/834,336** |
| Filed: | **Apr. 13, 2001** |

(51) Int. Cl.[7] ..... A41B 15/00
(52) U.S. Cl. ..... 2/279
(58) Field of Search ..... 2/279, 144, 207, 2/247, 244, 248; D2/500, 502, 503, 508; 40/1.5, 586; 24/3.5; 15/208, 209.1

(56) References Cited

U.S. PATENT DOCUMENTS

| | | | | | |
|---|---|---|---|---|---|
| 2,168,787 | A | * | 8/1939 | Beardsley | 2/279 |
| 2,296,665 | A | * | 9/1942 | Halter et al. | 2/279 |
| 2,722,013 | A | * | 11/1955 | Fisher | 2/279 |
| 3,704,470 | A | * | 12/1972 | Beno et al. | 2/279 |
| D297,482 | S | * | 9/1988 | Nagy | D2/508 |
| 5,253,370 | A | * | 10/1993 | Mead | 2/279 |
| D384,485 | S | * | 10/1997 | Kwak | D2/502 |
| D459,054 | S | * | 6/2002 | Kwak | D2/500 |

FOREIGN PATENT DOCUMENTS

| | | | | |
|---|---|---|---|---|
| JP | 0111703 | * | 1/2001 | |
| SU | 1679964 A | * | 9/1991 | 2/279 |

OTHER PUBLICATIONS

Translation of: Japanese Unexamined Published Patent Application 2001–11703, Published Jan. 16, 2001; Application Filing No. 11–179211.*

* cited by examiner

*Primary Examiner*—Amy Vanatta

(57) ABSTRACT

A pocket handkerchief is arranged to be displayed from a pocket, such as a breast pocket of a business suit. The pocket handkerchief is woven entirely of fabric and stitched such that an ornamental part of the handkerchief is visible when deposited in the pocket. The pocket handkerchief may be useful as a handkerchief, when needed. After use, the pocket handkerchief may be returned to the pocket and thereafter maintain its stylish quality.

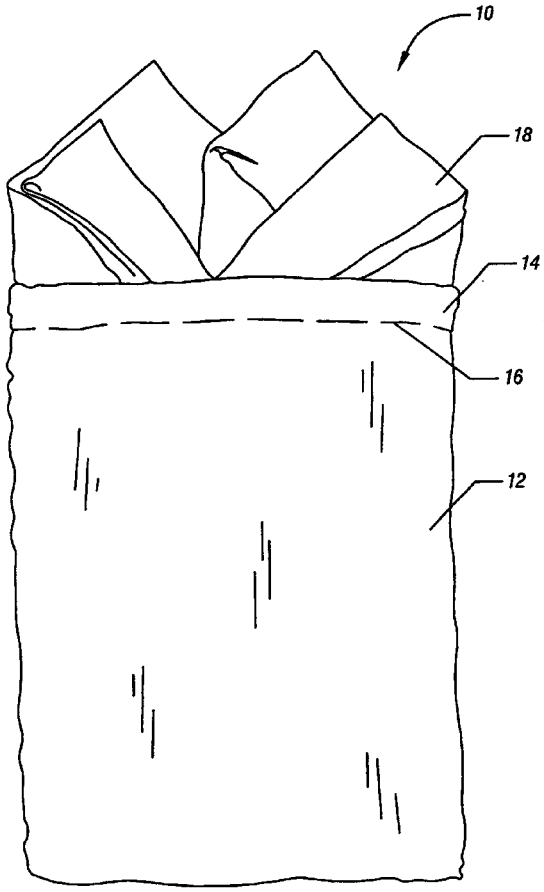

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–9 are cancelled.

* * * * *